US007669849B2

(12) United States Patent
Liu et al.

(10) Patent No.: US 7,669,849 B2
(45) Date of Patent: Mar. 2, 2010

(54) FOLLOWER ROLLER MOUNTING MECHANISM FOR PAPER FEEDING APPARATUS

(75) Inventors: Chun-Liang Liu, Banciao (TW); Jen-Chieh Liu, Danshuei Township, Taipei County (TW)

(73) Assignee: Lite-On Technology Corporation, Taipei (TW)

( * ) Notice: Subject to any disclaimer, the term of this patent is extended or adjusted under 35 U.S.C. 154(b) by 555 days.

(21) Appl. No.: 11/557,061

(22) Filed: Nov. 6, 2006

(65) Prior Publication Data

US 2007/0257415 A1 Nov. 8, 2007

(30) Foreign Application Priority Data

May 5, 2006 (TW) ..... 95207780 U

(51) Int. Cl.
*B65H 5/02* (2006.01)

(52) U.S. Cl. ..... 271/272; 271/273

(58) Field of Classification Search ..... 271/272, 271/273

See application file for complete search history.

(56) References Cited

U.S. PATENT DOCUMENTS 5,738,452 A * 4/1998 Uchida ..... 400/624
6,059,280 A * 5/2000 Yamauchi et al. ..... 271/109
6,089,567 A * 7/2000 Yatsuhashi et al. ..... 271/314
6,145,827 A * 11/2000 Harada et al. ..... 271/3.01
6,206,368 B1 * 3/2001 Kobayashi et al. ..... 271/273
6,877,743 B2 * 4/2005 Van Den Berg et al. ..... 271/273
7,080,836 B2 * 7/2006 Hamada et al. ..... 271/274
7,355,763 B2 * 4/2008 Furihata ..... 358/474
2004/0178571 A1 * 9/2004 Ohama et al. ..... 271/272
2004/0262837 A1 * 12/2004 Hamada et al. ..... 271/272
2005/0258587 A1 * 11/2005 Taniyama ..... 271/122
2007/0018387 A1 * 1/2007 Yamamoto ..... 271/272
2007/0069457 A1 * 3/2007 Terada ..... 271/272

* cited by examiner

*Primary Examiner*—Patrick H Mackey
*Assistant Examiner*—Howard Sanders
(74) *Attorney, Agent, or Firm*—Workman Nydegger

(57) ABSTRACT

A follower roller mounting mechanism for a paper feeding apparatus is provided, which has at least one follower roller and a shaft passing through the follower roller. The follower roller mounting mechanism includes a base having a trough and a hole on a top surface thereof. The trough has a back wall, a bottom wall, and two opposite lateral walls. The bottom wall and the back wall are adjacent to each other. Each of the lateral walls has a sliding slot. The shaft is disposed inside the base passing through the trough via the sliding slot for making the follower roller protruding from the top surface through the hole. An elastic element is disposed between the shaft and the back wall for generating elastic force, pushing the shaft sliding along the sliding slot, and making the follower roller to constantly rise above the top surface through the hole.

6 Claims, 5 Drawing Sheets

FOLLOWER ROLLER MOUNTING MECHANISM FOR PAPER FEEDING APPARATUS

CROSS-REFERENCE TO RELATED APPLICATIONS

This non-provisional application claims priority under 35 U.S.C. § 119(a) on Patent Application No(s). 095207780 filed in Taiwan, R.O.C. on May 5, 2006, the entire contents of which are hereby incorporated by reference.

BACKGROUND OF THE INVENTION

1. Field of Invention

The present invention relates to a paper feeding apparatus. More particularly, the present invention relates to a follower roller mounting mechanism for a paper feeding apparatus.

2. Related Art

Due to the increasing progress of photoelectric technology and development of business, products such as printers, scanners, photocopiers, and multi-function peripherals (MFP) have become a popular document processing apparatus widely used in not only the offices, families, and students but also in daily life.

The apparatuses such as printers, scanners, photocopiers, and MFP all have a paper feeding apparatus for feeding documents to be processed to the working area for processing. Generally speaking, the paper feeding roller set of the paper feeding apparatus has a plurality of driving rollers and follower rollers disposed at two sides of the paper feeding track. The driving rollers can be driven by external power source to feeding paper sheet. The follower rollers can be used together with the driving rollers to clamp paper sheet between the driving rollers and the follower rollers, and generate sufficient frictional force between the driving rollers and paper sheet to move the paper sheet. The follower rollers can also be disposed on the side surface of the paper feeding track alone, such that the paper sheet is prevented from directly contacting the side surface of the paper feeding track, and thus the paper sheet can be smoothly moved in the paper feeding track.

In view of the above requirements, the follower rollers must generate a normal force to the paper sheet, for generating sufficient frictional force between the driving rollers and paper to rotate the follower rollers which is driven by the paper sheet. In general, the shaft of the follower roller is loosely disposed in the base of the paper feeding apparatus, and the shaft and the follower roller are pushed by an elastic force generated by a spring. However, the follower roller mounting structure in the conventional paper feeding apparatus has a metal plate or a plastic plate mounted onto the inner side surface of the base for fixing the spring and the follower rollers, which results in a high cost and complicated assembling process.

As shown in FIG. 1, in order to eliminate the above limitations, another type of follower roller mounting structure 10 is developed. As shown in the figure, a supporting portion 11 is disposed on the paper feeding apparatus, and the supporting portion 11 has an opening 12 thereon. A shaft 13 passes through the opening 12 and is loosely disposed on the supporting portion 11. The follower roller 14 is disposed on the shaft 13, thereby contacting the driving roller (not shown) of the paper feeding apparatus. A spring 15 is fixed below the shaft 13 and presses against the shaft 13, so as to provide a normal force to the shaft 13, making the follower roller 14 contacts the driving roller.

However, as the spring 15 is fixed below the shaft 13, the shaft 13 must be detached before mounting or detaching the spring 15, which results in that the follower roller mounting structure 10 cannot be easily and quickly mounted or detached, thus reducing the assembling speed, increasing the time required for repairing, and increasing the cost of manufacturing.

Also, as the mounting position of the spring 15 in the conventional follower roller mounting structure 10 cannot be adjusted, the normal force generated by the spring mostly acts in ineffective direction, and thus the spring performance is not good. Due to uneven force applied to the shaft 13, the normal force generated by the follower roller 14 and being applied to the paper sheet is insufficient, and the follower roller 14 cannot be driven by the paper sheet to rotate and even sliding friction exists between the follower roller 14 and the paper sheet, and thus paper jam may occur or the paper sheet may be wrinkled.

SUMMARY OF THE INVENTION

Since the structure of the follower roller mounting structure in the paper feeding apparatus in the prior art is complicated, and it is not easy to control the normal force generated by the follower roller 14 and being applied to paper sheet, the paper sheet is not well guided by the follower roller. In view of the above, an object of the present invention is to provide a follower roller mounting structure for simplifying the assembling process and making the follower roller to generate sufficient normal force to paper.

To achieve the object, the present invention provides a follower roller mounting mechanism for a paper feeding apparatus. The paper feeding apparatus has at least one follower roller and a shaft passing through the follower roller. The follower roller mounting mechanism includes a base having a shaft disposed therein, wherein the base has a trough and an hole on a top surface thereof. The trough has a back wall, a bottom wall, and two opposite lateral walls. The bottom wall and the back wall are adjacent to each other. Each of the lateral walls has a sliding slot. The follower roller shaft passes through the two sliding slots to make the follower roller rise above the top surface via the hole. The follower roller mounting mechanism of the present invention further includes an elastic element disposed in the trough. One end of the elastic element presses against the shaft of the paper feeding apparatus, and the other end presses against the back wall of the trough.

Preferably, a post is further formed on the back wall, and one end of the elastic element is fitted on the post to presses against the back wall. A cap can also be provided to cover the trough, so as to constrain the elastic element between the cap and the bottom wall.

The advantage of the present invention is that the assembling process of the follower roller mounting mechanism is simplified, and cost of manufacturing is reduced. And a normal force is certainly applied by the follower roller to paper sheets.

Namely, in the follower roller mounting mechanism of the present invention, as the direction of the elastic element pressing against the shaft is perpendicular to the direction of the paper passing over the top surface of the base, and the extending direction of the sliding slot of the lateral wall is perpendicular to the direction of paper passing over the top surface of the base, the normal force generated by the elastic element can fully act on the shaft without producing useless component of force.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus is not limitative of the present invention, and wherein.

DETAILED DESCRIPTION OF THE INVENTION

The follower roller mounting mechanism provided by the present invention can be applied to paper feeding apparatuses of FAX machines, photocopiers, multi-function peripherals (MFP), scanners, or the like. In the following detailed description of the present invention, an automatic paper feeding apparatus is taken as a preferred embodiment of the present invention, and the accompanying drawings are reference for illustration, and will not intended to limit the present invention.

Figure 1:
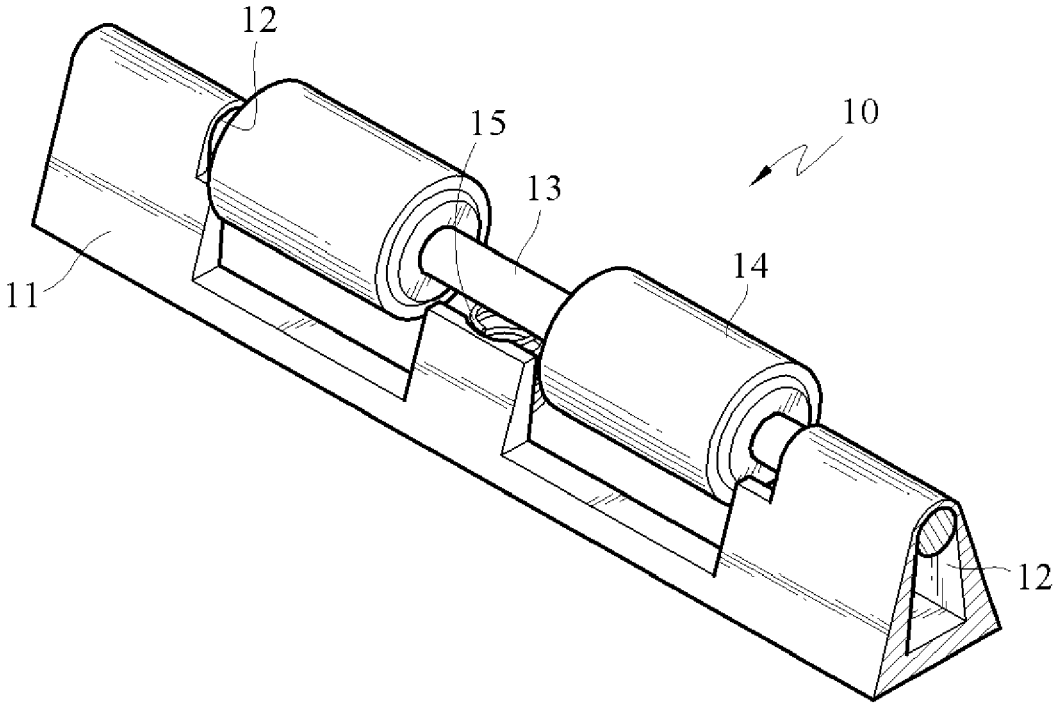
FIG.1 (PRIOR ART)
FIG. 1 is a schematic view of a follower roller mounting structure for a paper feeding apparatus in the art.
Figure 2:
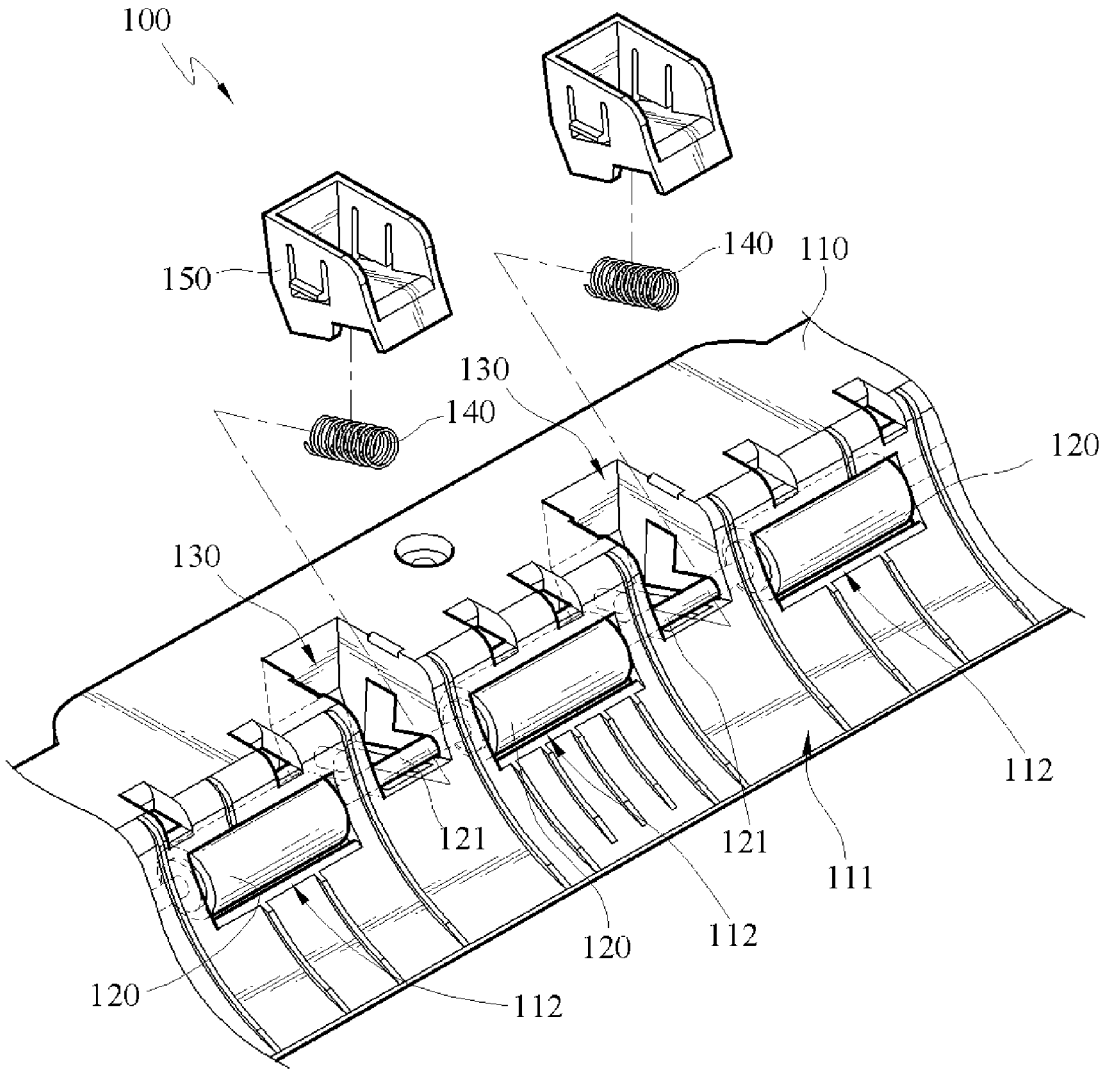
FIG. 2 is an exploded schematic view of an embodiment of the present invention.
Figure 3:
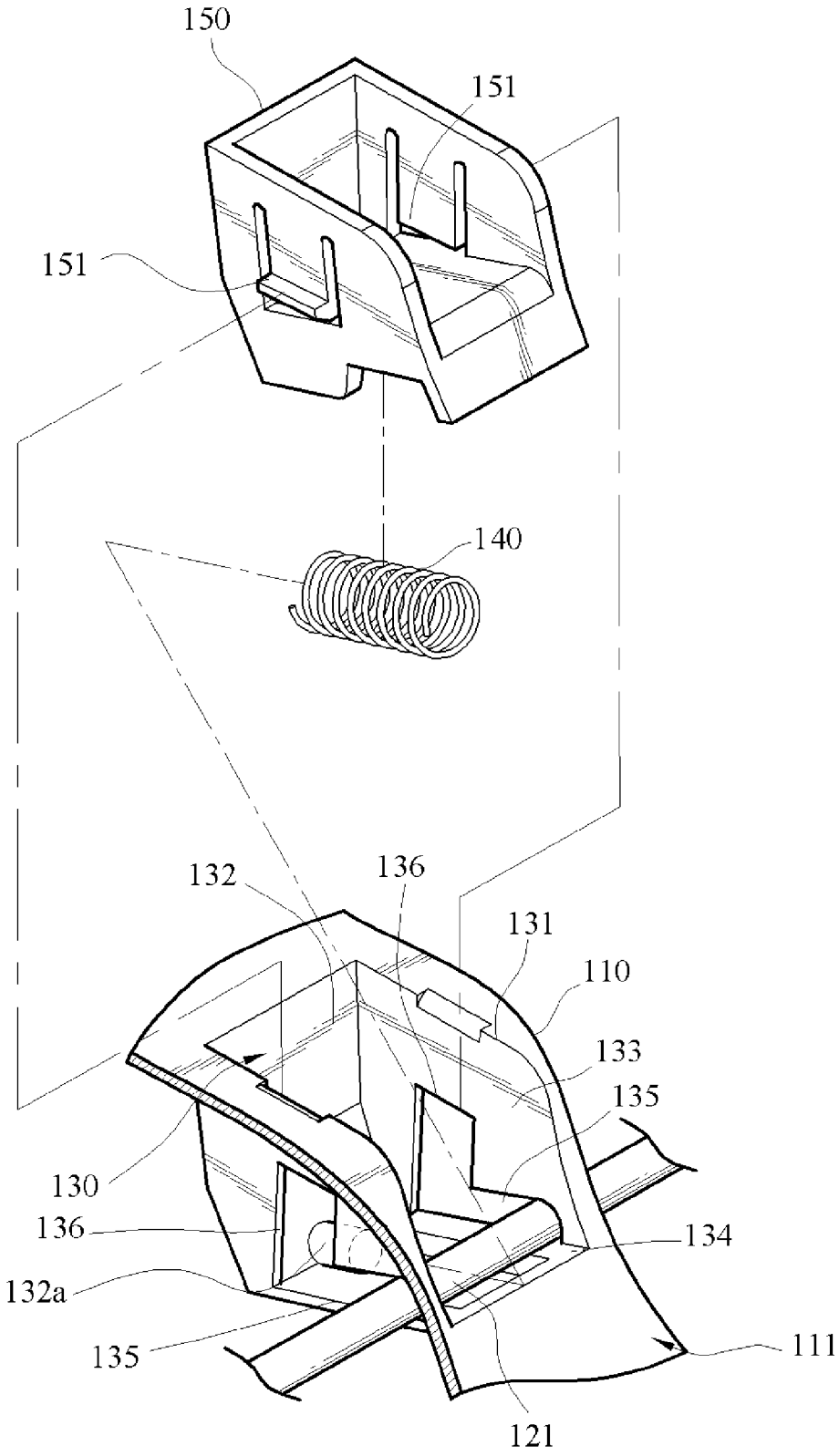
FIG. 3 is a partial enlarged exploded schematic view of an embodiment of the present invention.

As shown in FIGS. 2 and 3, a follower roller mounting mechanism 100 in an embodiment of the present invention for a paper feeding apparatus is provided. The paper feeding apparatus has at least one follower roller 120 and a shaft 121 passing through the follower roller 120. For example, the paper feeding apparatus of the present invention has three follower rollers 120, and the shaft 121 passes through the central axis of the three follower rollers 120 at the same time, so as to fix the three follower rollers 120 to the shaft 121.

The follower roller mounting mechanism 100 includes a base 110, a plurality of elastic elements 140, and a plurality of caps 150. The base 110 is corresponding to one side of the paper feeding track (not shown) of the paper feeding apparatus. The base 110 has one or more troughs 130 disposed on a top surface 111 thereof. In the present embodiment, the base 110 has two troughs 130, and each of the troughs 130 has an opening 131, a back wall 132, two opposite lateral walls 133, and a bottom wall 134.

A post 132*a* is formed on the back wall 132. Two lateral walls 133 are corresponding to the two opposite edges of the opening 131. Each of the lateral walls 133 has a sliding slot 135 and a locking slot 136 formed thereon. The extending direction of the sliding slot 135 is perpendicular to the direction of the paper sheet passing over the top surface 111. The locking slot 136 is connected to the sliding slot 135. The shaft 121 is movably disposed in the base 110, wherein the shaft 121 passes through the trough 130 via the sliding slot 135, so that the shaft 121 is able to slide in the sliding slot 135. The back wall 132 and the bottom wall 134 are adjacent to each other, and the bottom wall 134 is perpendicular to the moving direction of the paper sheet.

A plurality of holes 112 is formed on the top surface 111 of the base 110, each of the holes 112 is provided respectively corresponding to the follower rollers 120, thereby when the shaft 121 passes through the trough 130 to be movably disposed in the base 110, a part of the follower roller 120 is embedded in the base 110 and the other part rise above the top surface 111 of the base 110.

The number of the elastic elements 140 corresponds to the number of the troughs 130, and each of the elastic elements 140 can be a compression spring. Each of the troughs 130 has an elastic element 140 therein, wherein one end of the elastic element 140 is fitted on the post 132*a* to press against the back wall 132 of the trough 130, and the other end of the elastic element 140 presses against the shaft 121 to provide a normal force to make the follower roller 120 rise above the top surface 111 of the base 110. In addition, the extending direction of the post 132*a* and the direction of force generated by the elastic element 140*d* are perpendicular to the direction of a paper sheet passing over the top surface 111, such that the direction of the elastic element 140 pressing against the shaft 121 is also perpendicular to the direction of a paper sheet passing through the top surface 111. Thus, the normal force generated by the elastic element 140 can be fully applied to the shaft 121 without producing useless component of force.

Figure 4:
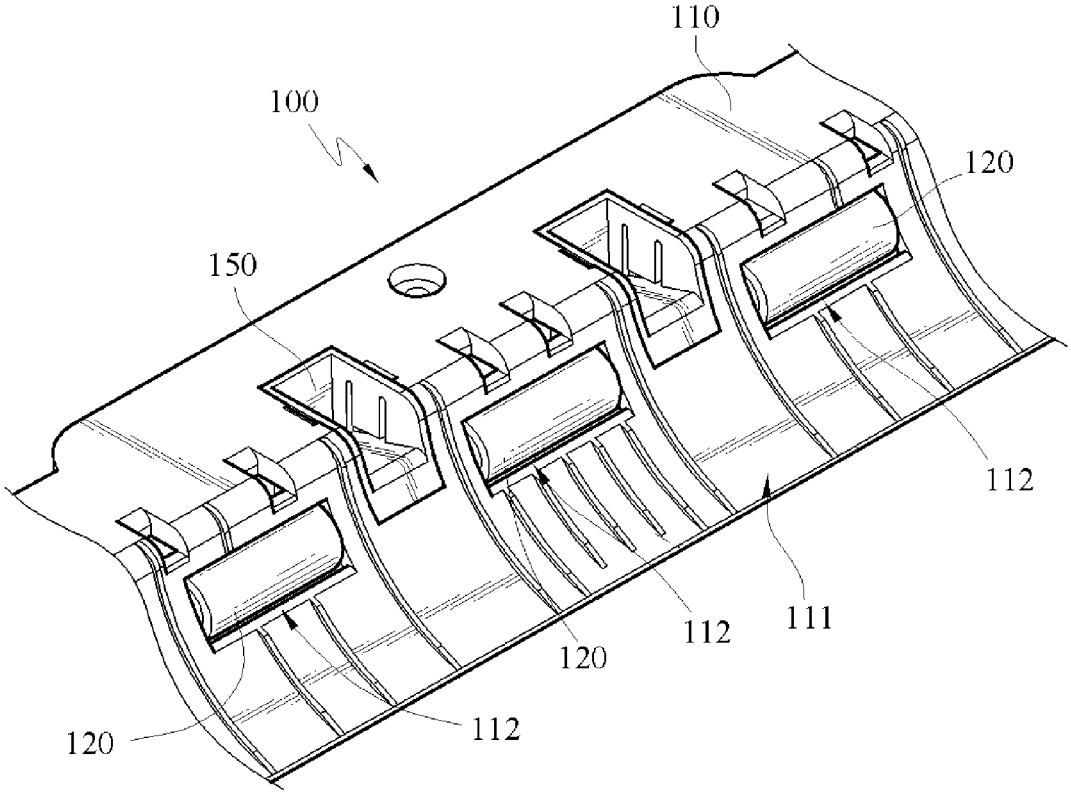
FIG. 4 is a schematic view of an embodiment of the present invention.
Figure 5:
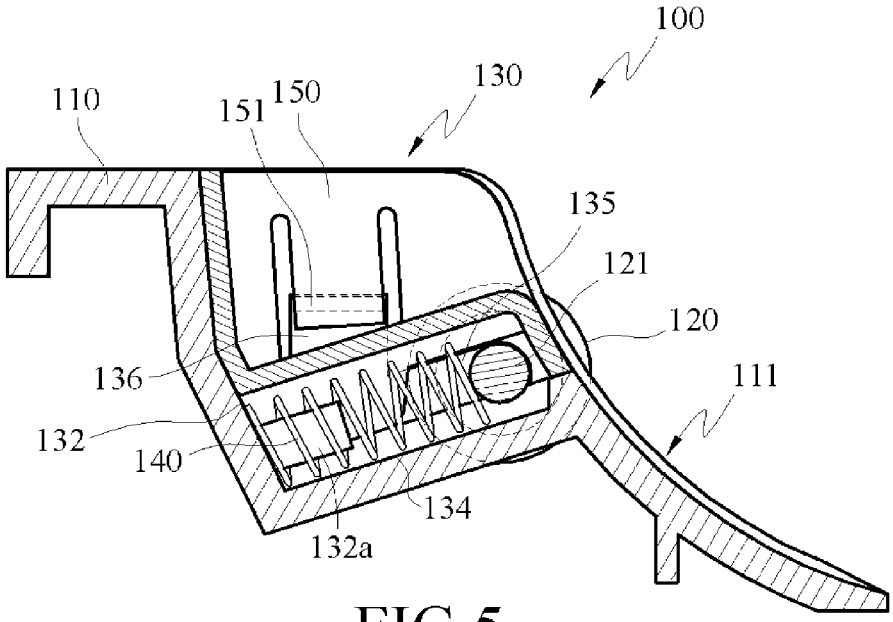
FIG. 5 is a sectional side view of an embodiment of the present invention.

As shown in FIGS. 4 and 5, the number of caps 150 also corresponds to the number of the troughs 130. Each of the caps 150 covers the opening 131 of the trough 130 to seal the trough 130. Each of the caps 150 has two hooks 151 respectively engaged into the locking slots 136 on the two lateral walls 133 of the trough 130 to fix the caps to the opening 131 of the trough 130. The caps 150 can also be used together with the bottom wall 134 of the through 130 to limit the position of the elastic element 140, to constrain the elastic element 140 therebetween, thus preventing the elastic element 140 from being compressed to deform, which may change the direction of the force, and avoiding producing useless component of force.

Figure 6:
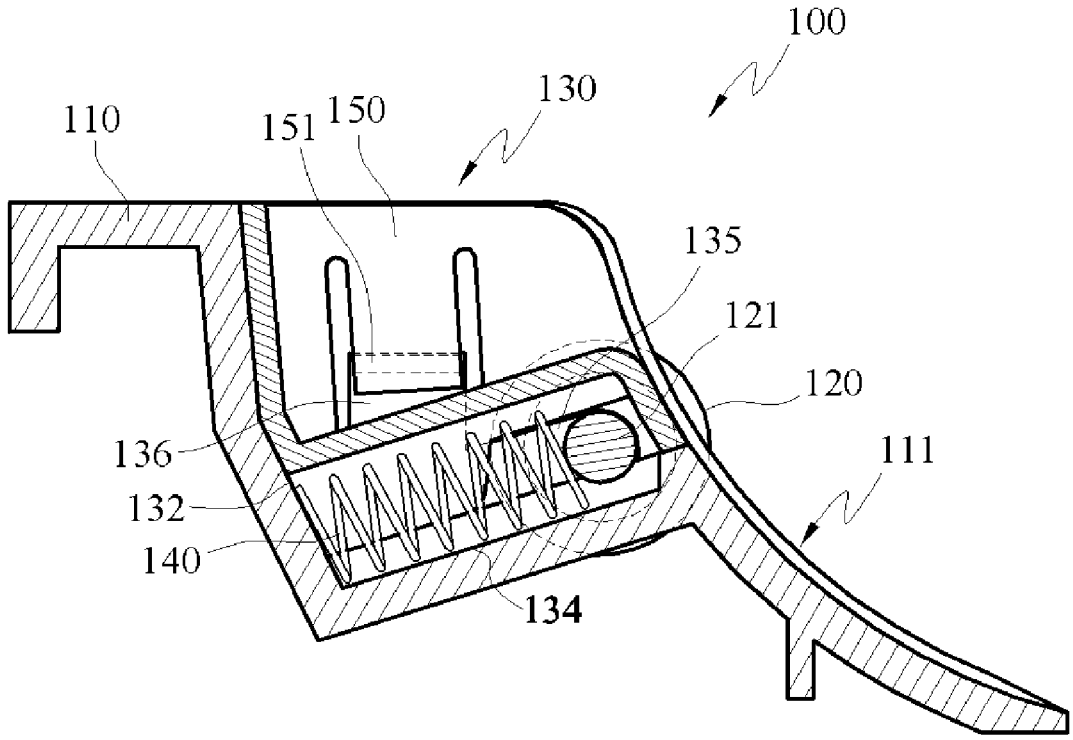
FIG. 6 is a sectional side view of another embodiment of the present invention.

As shown in FIG. 6, the posts 132*a* can also be omitted. Through the bottom wall 134 and the cap 150, the elastic element 140 is constrained at a predetermined position without getting loose, with two ends pressing against the back wall 132 and the shaft 121.

according to the present invention, the elastic element 140 can constantly apply an elastic force to the shaft 121 to make the follower roller 120 rise above the top surface 111 of the base 110 through the hole 112, so as to generate a normal force to the paper sheet passing through the top surface, thus forming a friction contact relationship between the paper sheet and the follower roller 120 to drive the follower roller 120 to rotate, and making the paper sheet smoothly moving.

In addition, as the elastic element 140 in the follower roller mounting mechanism 100 described in the present invention can be mounted or detached without detaching the shaft 121 in advance. The direction of the elastic element 140 being compressed is perpendicular to the moving direction of the paper sheet, the normal force generated by the elastic element 140 can be fully applied to the follower roller 120, thus reducing the generation of useless component of force and eliminate the phenomenon of insufficient frictional force between paper sheet and the follower roller 120.

Therefore, the present invention has efficacies of simplifying the assembling process of the follower roller mounting mechanism, effectively providing a normal force between paper sheet and roller, and reducing the cost.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A follower roller mounting mechanism for a paper feeding apparatus, the paper feeding apparatus having at least one follower roller and a shaft passing through the follower roller, the follower roller mounting mechanism comprising:

a base, having the shaft disposed therein, wherein the base has a trough and a hole on a top surface of the base, the trough has a back wall, a bottom wall, and two opposite lateral walls, the bottom wall and the back wall are adjacent to each other, each of the lateral walls has a sliding slot, the shaft passes through the two sliding slots to make the follower roller rise above the top surface of the base through the hole, and wherein at least one of the lateral walls is with a locking slot;

an elastic element, disposed inside the trough, having one end pushing against the shaft and the other end pushing against the back wall of the trough; and a cap, covering the trough to clamp the elastic element between the cap and the bottom wall, and having a hook corresponding to the locking slot to be embedded in the locking slot.

2. The follower roller mounting mechanism for a paper feeding apparatus as claimed in claim 1, wherein the elastic element is a compression spring.

3. The follower roller mounting mechanism for a paper feeding apparatus as claimed in claim 1, the direction of the elastic element pushing against the shaft is perpendicular to the direction of a paper sheet passing through the top surface of the base.

4. The follower roller mounting mechanism for a paper feeding apparatus as claimed in claim 1, wherein the extending direction of the sliding slot is perpendicular to the direction of a paper sheet passing through the top surface of the base.

5. The follower roller mounting mechanism as claimed in claim 1, wherein the bottom wall is perpendicular to the direction of a paper sheet passing through the top surface.

6. The follower roller mounting mechanism for a paper feeding apparatus as claimed in claim 1, wherein the locking slot is connected to the sliding slot.

* * * * *